United States Patent [19]

Okane et al.

[11] 4,388,084

[45] Jun. 14, 1983

[54] PROCESS FOR GASIFICATION OF SOLID CARBONACEOUS MATERIAL

[75] Inventors: Koji Okane, Chiba; Shozo Okamura, Asomachi; Masanobu Sueyasu, Kawachinagano; Seiichi Masuda, Nishinomiya; Tsutomu Tanaka; Koichi Tanaka, both of Chiba, all of Japan

[73] Assignee: Sumitomo Metal Industries, Ltd., Osaka, Japan

[21] Appl. No.: 290,520

[22] Filed: Aug. 6, 1981

[30] Foreign Application Priority Data

Dec. 1, 1980 [JP] Japan ..... 55-169982

[51] Int. Cl.[3] ..... C10J 3/46

[52] U.S. Cl. ..... 48/197 R; 48/92; 48/206; 48/210; 252/373

[58] Field of Search ..... 48/197 R, 202, 203, 48/206, 210, 92; 252/373; 75/60, 59, 40

[56] References Cited

U.S. PATENT DOCUMENTS 4,043,766 8/1977 Gemhardt et al. ..... 48/92

FOREIGN PATENT DOCUMENTS 17963 10/1980 European Pat. Off. ..... 75/60
2443740 3/1975 Fed. Rep. of Germany .
52-41604 3/1977 Japan .
52-41605 3/1977 Japan .
52-41606 3/1977 Japan .
2043677 10/1980 United Kingdom ..... 48/92

*Primary Examiner*—Peter F. Kratz

[57] ABSTRACT

In a process for gasification of solid carbonaceous material such as coal, powdered coal is top-blown onto a molten iron bath stored in a furnace through a non-submerged lance toward a hot spot formed by means of a jet of oxygen and steam top-blown through a non-submerged lance, the coal being blown by means of a carrier gas, and flux is optionally added into the furnace by the lump or blown toward the hot spot, thereby resulting in the coal being gasified. The ratio $L/L_o$ of the depression depth L of the molten iron bath to the molten iron bath depth $L_o$ is maintained from 0.05 to 0.15, and the blowing velocity of the solid carbonaceous material is maintained from 50 to 300 m/sec so as to suppress the formation of an adhered mass on the upper part of the furnace, hood or lance.

10 Claims, 3 Drawing Figures

PROCESS FOR GASIFICATION OF SOLID CARBONACEOUS MATERIAL

BACKGROUND

The present invention relates to a process for the gasification of solid carbonaceous material wherein the solid carbonaceous material is gasified in a gasification reactor furnace with a molten iron bath. Particularly, the present invention relates to a process for operating the gasification reactor furnace which prevents the forming of an adhered mass due to splash on the upper part of a furnace, a hood, or a lance, and to stabilize the furnace operation and provide a long-lasting operation.

Generally speaking, so-called a coal gasification process using a gasification furnace with a molten iron bath is a process wherein the heat necessary for the gasification is supplied from the molten iron. Among known processes for gasifying solid carbonaceous material e.g., coal, coke or the like there are disclosed a series of processes in laid-open Japanese patent applications JA-OS Nos. 52-41604, 52-41605 and 52-41606. The essential nature of those processes consist of introducing coal into a furnace either by dropping coal onto a bath surface or by introducing coal by the aid of a carrier gas into the molten iron bath through an opening mounted below the bath level, and blowing oxygen and/or steam into the furnace through a different way and to different portions in the furnace from the manner and portion by and to which the coal is introduced. Due to such features the coal utilization efficiency at gasification is low and other drawbacks are inescapable as follows:

(I) As, if the coal is dropped on the molten iron, the coal is caught by the floating slag on the bath surface then a part thereof being dissolved into the molten iron by agitation, the loss of coal by splashing away or by floating with the slag without being gasified will increase, the coal utilization efficiency will be as low as not more than 80%, the $CO_2$ content in the resultant gas will not be able to be depressed below to 5 to 6%, resulting in no effective gasification.

(II) Sulfur in the floating coal will directly react with oxygen to produce $SO_x$ and thus the expected advantage of the gasification of this type that no sulfur would be contained in the produced gas will be lost.

(III) Since the portion of coal introduction and that of blowing an oxygen jet are different and apart from each other, a hot spot or so-called fire point with a super-high temperature will be formed, e.g., on the surface of the molten iron bath if oxygen is top-blown, loss of the molten iron due to its evaporation will be large, a large amount of combustible metal iron containing micro carbon particles will be contained in the produced gas resulting in danger in dust treatment, and the furnace operation would become difficult due to the iron loss.

DE-OS No. 2443740 discloses a process also falling within the same essential nature as the abovementioned JA-OS, therefore being inescapable from the abovementioned disadvantages.

A known process disclosed in JA-OS 55-89395 applied by the assignee of the present application to a considerable extent eliminated such disadvantages in the prior art aforementioned and the utilization efficiency of C of the solid carbonaceous material was improved. According to this JA-OS, oxygen is top-blown through a non-submerged lance onto a molten iron bath surface forming a hot spot or so-called firing point with a high temperature toward which a solid carbonaceous powder is pneumatically top-blown through a non-submerged lance by the aid of a carrier gas. Thereby, the amount of the solid carbonaceous material caught by the floating slag on the iron bath was reduced. In a furnace of a type usually similar to a converter in which a molten iron bath of 1300°–1500° C. is stored, the coal (powdered coal) and a gasifying agent are top-blown through the non-submerged lance toward the molten iron with the coal thereby being gasified. This process using the converter type furnace facilitates the feeding of coal and gasifying agent into the furnace, and is capable of gasifying any kind of coal to the advantage. However, the molten iron will be splashed from the bath during operation due to the jet of the gasifying agent resulting in forming an adhered mass on the upper part of the furnace or hood, or surface of the lance (on water cooling pipe) on its rapid cooling, which would raise difficulties in the operation. Once an amount of the adhered mass has been formed, it will consistently grow until a throat of a furnace and hood will be likely to be blocked, whereon the pressure control in the furnace is strongly inhibited finally leading to an inoperable condition.

Therefore, according to that process it was difficult to maintain a long-lasting operation particularly when using the converter type furnace, also it was necessary to break or stop the operation in order to remove the adhered mass resulting in a non-stable supply of the produced gas, which is drawn to drawbacks of that process.

SUMMARY OF THE INVENTION

Accordingly, there is much to be desired in the prior art aforementioned, and it is an object of the present invention to provide a novel process for the gasification of solid carbonaceous material wherein the drawbacks aforementioned in the prior art may be eliminated.

Particularly, it is an object of the present invention to provide a process for the gasification of solid carbonaceous material wherein the forming of adhered mass on the upper part of a furnace or hood can be prevented to allow long-lasting operation of the furnace.

It is a further object of the present invention, to provide such a process for gasification of solid carbonaceous material that sulfur content in the produced gas is depressed to a possible minimum amount.

The present invention provides a process for the gasification of solid carbonaceous material in which pulverized solid carbonaceous material is top-blown onto a molten iron bath stored in a furnace through a non-submerged lance toward a hot spot formed by means of a jet of a gasifying agent comprising at least oxygen, the gasifying agent being top-blown through a non-submerged lance and the solid carbonaceous material being blown by means of a carrier gas, and slag-forming material is optionally blown toward the hot spot, thereby the solid carbonaceous material being gasified, wherein the ratio $L/L_o$ of the depression depth L of the molten iron bath to the molten iron bath depth $L_o$ is maintained from 0.05 to 0.15, and the blowing velocity of the solid carbonaceous material is maintained from 50 to 300 m/sec so as to suppress the forming of an adhered mass on the upper part of the furnace or hood.

The present invention further provides such a process as aforementioned with an additional feature, wherein the ratio $L'/L_o$ of the penetration depth L' of the solid carbonaceous material into the molten iron bath to the molten iron bath depth $L_o$ is maintained from 0.15 to 0.3.

In the followings, the preferred embodiment of a present invention is disclosed by hand of accompanying drawings which, however, are shown for better illustration and not for limitation thereof.

DETAILED DESCRIPTION OF THE INVENTION

Figure 1:
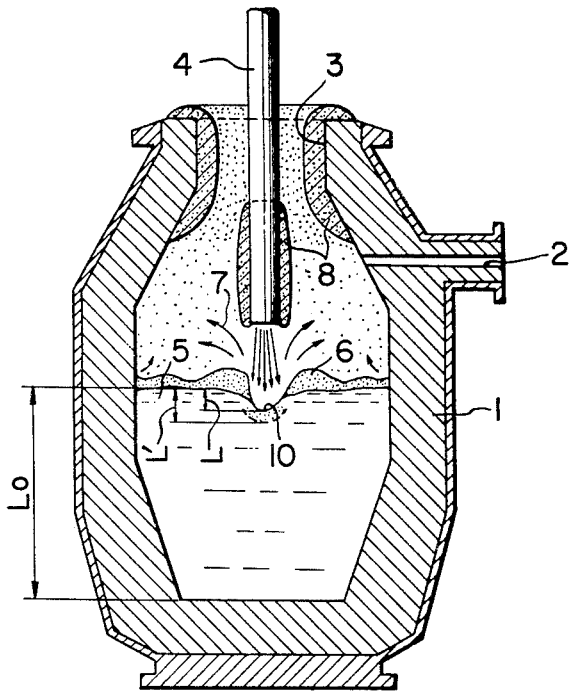
FIG. 1 shows a cross sectional view of a gasification reactor furnace for performing an embodiment of the present invention.

FIG. 1 shows a gasification reactor furnace 1 of a converter type, which is provided with an exhaust port for steel and/or slag 2 and a non-submerged lance 4 of a multiple nozzle type for top blowing the pulverized solid carbonaceous material, oxygen and steam, and is storing an appropriate amount of a molten iron bath 5 therein. A jet of the gasifying agent which is top-blown through the lance 4 produces a hot spot 10 on the iron bath surface within a depression, and toward the hot spot 10 the carbonaceous material being pneumatically blown by means of a carrier gas, whereon the carbonaceous material is converted to gas, i.e., gasified.

At the same time, slag 6 is produced on the molten bath level due to residual ash components in the carbonaceous material upon its gasification. Alternatively or additionally the slag 6 is formed from slag-forming material which is blown, preferably, together with the carbonaceous material. The slag-forming material may be thrown into the furnace.

The solid carbonaceous material in the present invention encompasses known materials containing a substantial amount of carbon, e.g., coal, coke, pitch, coal-tar, and the like. Hereinbelow, the solid carbonaceous material is represented by coal (powdered coal) as a preferred embodiment.

The gasifying agent comprising at least oxygen encompasses a gas substantially containing oxygen or a gas mixture of oxygen and steam. The oxygen content should be 70% by volume or more in order to supply sufficient oxygen without causing the iron bath to cool. Steam is preferably added if oxygen is 99% by volume or more. Most preferred is to employ pure oxygen and steam. However, steam may be employed at an oxygen content of 70~99% by volume provided that it brings cost down.

Blowing is conducted through a lance or lances, preferably, of a multiple nozzle type which at least allows coal to be blown by means of a carrier gas and oxygen through one lance. Steam may be blown either through the same lance with oxygen or a separate lance. The optional blowing of the slag-forming material is preferably effected through the same nozzle for blowing oxygen or coal. However, different arrangements in the blowing technique through the lance can be made without departing from the gist of the present invention. Conventional single nozzle lances may be used in a bundle or a set.

The gasification reactor furnace 1 is preferably of a converter type as shown in FIG. 1, however a furnace of an open hearth type, e.g., as disclosed in JA-OS 55-89395 may be employed depending upon the scale of operation. Hereinafter is being disclosed a preferred embodiment using the converter type furnace 1.

The furnace 1 is operated as hereinbelow disclosed. Molten iron is charged through a mouth 3, the produced gas is introduced to a gas holder (not shown) through a hood and duct (not shown) for gas recovery arranged over the mouth 3. Slag may be exhausted through an exhaust port 2 at a side position of the furnace 1, or through the mouth 3.

Figure 2:
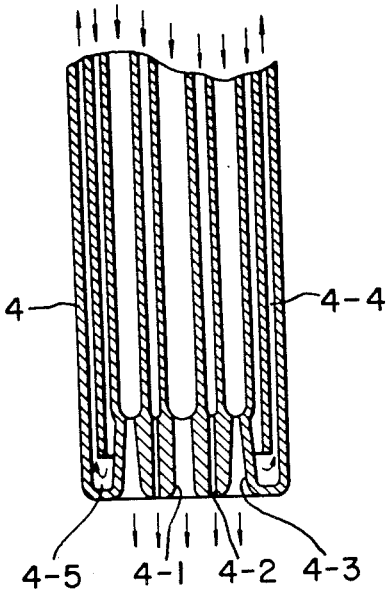
FIG. 2 shows a longitudinal sectional view of a lance.
Figure 3:
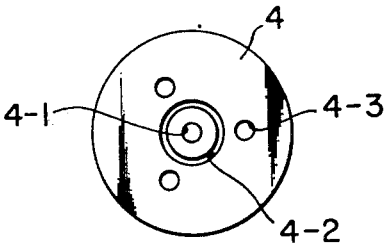
FIG. 3 shows a bottom view of FIG. 2.

A non submerged lance 4 with multiple nozzles 4-1, 4-2, 4-3 is shown in FIGS. 2 and 3 which enables coal and the carrier gas, oxygen, and steam to be blown through one lance via three types of nozzles. The lance 4 includes a center nozzle 4-1, an annular slit nozzle 4-2 encirculating the center nozzle 4-1, and three triangularly located nozzles 4-3 at the peripheral portion of the annular slit nozzle 4-2. Through the center nozzle 4-1 is blown a mixture fluid of coal and the carrier gas, through the slit nozzle 4-2 is blown steam, and through the peripheral nozzles 4-3 is blown oxygen, respectively. A water cooling channel 4-4 with double shell structure is provided extending to the lance bottom whereat turning chamber 4-5 connects inlet and outlet channels.

On gasification of coal, coal, oxygen and steam are top-blown through the non-submerged lance 4 via respective nozzles onto the molten iron bath (iron bath hereinafter). Thereon, the coal is blown by means of the carrier gas toward the hot spot 10 which is formed through the jet blow of the gasifying agent, i.e., oxygen and steam, whereat splash 7 of iron bath is splashed from the iron bath surface, particularly at the hot spot 10.

According to the prior art, the splash was caught on the upper part of the furnace or hood, lance and the like and rapidly cooled thereon to form a solid adhered mass 8, resulting in a serious problem barring continuous operation due to the likelihood of blockage at the mouth 3 and nozzle-portion of the lance. In the prior art, so-called hard-blowing as is the usual manner of blowing in converter operation, would have been considered essential for the gasification with high efficiency of coal utilization and such blockage could hardly be obviated.

Now, according to the present invention, such forming of the adhered mass can be suppressed by operating the furnace under specified conditions without deteriorating the utilization efficiency of coal, i.e., a so-called $L/L_o$ ratio of the depression depth L of the iron bath to the iron bath depth $L_o$ is maintained from 0.05 to 0.15, and the blowing velocity of the solid carbonaceous material is maintained from 50 to 300 m/sec. The ratio $L/L_o$ is preferably maintained from 0.1 to 0.15. This ratio $L/L_o$ is mainly defined by the penetration depth of a jet of gasifying agent, whereas the coal blowing velocity is mainly determined by the carrier gas velocity upon blowing.

Under those conditions the furnace can be operated for a long period by eliminating splashing and thus deposit and growth of the adhered mass during the operation.

Most preferred is to also maintain another ratio $L'/L_o$ of the penetration depth L' of the solid carbonaceous material into the iron bath to the iron bath depth $L_o$ within a range from 0.15 to 0.3. According to maintaining such conditions, the present invention enables not only long-lasting stable operation of the furnace but also yields a produced gas with a minimum impurity amount of sulfur.

The jet depression ratio $L/L_o$ should not be below 0.05 because, then, the composition of the produced gas is deteriorated, whereas the ratio $L/L_o$ should not exceed about 0.15 because, then, formation of adhered mass can not be suppressed, furthermore, the loss in the iron bath would be enhanced due to spitting. Usually, the ratio $L/L_o$ may be dominantly controlled by varying the distance from the nozzle (lance end) and the iron bath surface under a preset condition of gasifying agent jet and coal blowing velocity during an operation. However minor control can be effected by varying also the gasifying agent jet and/or coal blowing velocity within the prescribed range.

The coal penetration depth ratio $L'/L_o$ is determined predominantly by the coal blowing velocity, the term "coal penetration depth" is to be construed as the depth up to which the pulverized solid carbonaceous material penetrates into the iron bath in a form of a particle (solid). The coal penetration ratio $L'/L_o$ should not exceed about 0.3 because, then, the coal is too intensively blown into the iron bath resulting in increased splashing due to agitatingly vivid gasification, whereas the ratio $L'/L_o$ should not be below about 0.15 because, then, the desulfurization efficiency would decrease resulting in sulfur increase in the resultant gas. This lower limitation corresponds also to the coal blowing velocity wherein at a low velocity the coal would not penetrate enough into the iron bath accompanied by a lower coal gasification efficiency.

Generally in the converter operation for steel-making the ratio $L/L_o$ of the oxygen jet penetration depth L to the iron bath depth $L_o$ is determined depending upon purpose of each blowing, as movement in the iron bath greatly affects the condition of blowing, whereas the ratio $L/L_o$ is determined in order to eliminate the detrimental effect caused by the adhered mass on gasification of coal without deteriorating other factors as a result.

The coal blowing velocity is limited within a range from 50 to 300 m/sec at the nozzle because at a lesser velocity the sulfur in the coal would not be caught sufficiently into the iron bath and slag, and slag-formation of ash component would be insufficient, whereas at a greater velocity abrasion of the nozzle would be enhanced and blowing energy cost would become greater.

The iron bath is approximately maintained at a temperature from 1300° to 1600° C. preferably around 1500° C. during operation, which, however, should be determined in relation with the nature of slag and C content in the iron bath.

According to the present invention resultant coal utilization efficiency of about 96% can be achieved which is as high as the best of those in the prior art with a greater $L/L_o$ ratio (see JA-OS No. 55-89395 Ex. 2, maximum efficiency:96.1%; Ex.1, $L/L_o$: 0.58–0.79). In order to further enhance the coal utilization efficiency an auxiliary lance as disclosed in the above JA-OS may be employed, i.e., by blowing steam, oxygen, or the like without coal onto the iron bath at a separate portion.

The oxygen jet velocity in the present invention amounts to approximately from 1~3 Mach measured at the nozzle end, and the steam is blown about at 1 Mach.

The carrier gas for blowing coal encompasses oxygen, steam, air, $N_2$, Ar, $CO_2$, recycled make-gas, combustion exhaust gas generated in a discharging chamber of produced slag, and coke oven gas.

The depth of the iron bath $L_o$ is adopted generally according to conventional converter technology depending upon the size and type of furnace to be employed. However, $L_o$ in the present invention ranges from 0.6 to 1.0 m for a 15 t furnace, preferably from 0.7 to 0.9 m.

In the present invention, an additional step of blowing slag-forming material or flux toward the hot spot in a manner as disclosed in JA-OS No. 55-89395 can be employed. Such flux encompasses burnt lime powder, limestone, calcined dolomite, converter slag powder, fluorspar, soda ash and as a slagging agent. The essential purpose of slag formation is absorption of or reaction with sulfur present in coal. Such flux may be blown together with oxygen, steam or the carrier gas for coal, and is preferably blown through the same nozzle as the coal.

General conditions for the operation of the process for coal gasification as set forth in JA-OS No. 55-89395 or corresponding U.S. patent application Ser. No. 107316 assigned to the same assignee, to which the present application is to be assigned, subject to particular conditions as disclosed herein may be applied. Some standard feeding rates are as follows: The coal feeding rate amounts to about 0.3 t/pig.t.hr. Oxygen blowing rate is approximately 610 Nm/coal.t, steam blowing rate is around 150 Kg/coal.t at 300° C. at a pressure from 2 to 6 $Kg/cm^2G$. Flux-blowing rate is around 47 Kg/coal.t which, however, varies depending upon nature of coal. The feeding rates of coal and gasifying agent may be increased up to 4 to 5 times of the standard rates. C content in the iron bath ranges approximately from 1 to 2% by weight.

Accordingly, the present invention enables the forming of an adhered mass on the upper part of the furnace or hood, or lance to be suppressed by means of controlling the $L/L_o$ ratio of the gasifying agent jet penetration depth L to the iron bath depth $L_o$ and coal blowing velocity, thus also enabling a conventional converter type furnace to be employed for gasification of the solid carbonaceous material with the great advantage of a long and stable supply of the produced gas including a minimal amount of sulfur.

EXAMPLES

["%" represents weight ratio if not otherwise indicated]

EXAMPLE 1

15 tons of molten iron (1500° C., C:1.5%, S:1.1%, P:0.3%) was stored in a converter type furnace with a maximum inner diameter horizontal of 2.3 m, mouth diameter of 1.3 m, effective height of 4 m, and chamber volume of 13 $m^3$, into which coal (C: 77.6%, H:4.8%, N:1.8%, O:2.5%, S:0.8%, ash:9.6%, $H_2O$:2.9%) was fed by a rate of b 3.5 ton/hr to gasify the coal. A lance as shown in FIGS. 2 and 3 was used for blowing coal, oxygen and steam. The multi-nozzle lance includes a center nozzle of 15.7 mm diameter, a slit nozzle of 3 mm width, and three peripheral nozzles of 12.1 mm diameter. Coal was blown through the center nozzle at 200 m/sec velocity, and by 3.5 ton/hr feeding rate. Steam was blown at 1 Mach by 400 Kg/hr rate through the slit nozzle. Oxygen was blown at 2 to 3 Mach by a rate of 2000 $Nm^3$/ hr. The oxygen jet penetration depth ratio L/Lo was maintained variable within a range from 0.05 to 0.15 during operation. The coal penetration depth ratio L'/Lo was adjusted within a range from 0.15 to 0.30. $L_o$ was 0.85 m.

A 5 day-continuously running operation under the above conditions was successfully carried out to gasify the coal. The average composition of the resultant produced gas is shown in Table 1. The average coal utilization efficiency amounted to 96% without additional blowing for increasing the efficiency.

After operation was ceased, the inside of the furnace was inspected with respect to the forming of an adhered mass on the wall and lance. No substantial deposition which would cause the control of chamber pressure to be disturbed was found. On the lance, there was confirmed only a slight deposition without forming such a deposition that would cause to block the nozzles. Only slight abrasion of the nozzles was observed.

The distance between the iron bath surface and the lance end ranged from 1400 to 1500 mm during the operation. Excess slag was discharged time to time.

TABLE 1

| CO | $CO_2$ | $H_2$ | $N_2$ | $O_2$ | Total S |
|---|---|---|---|---|---|
| 62.3 | 2.0 | 34.1 | 1.4 | 0.02 | <100 ppm |

EXAMPLE 2

Flux composed of burnt lime powder and fluorspar was blown through the same nozzle with the coal at feeding rates of 150 to 280 Kg/hr for the burnt lime powder and 0–40 Kg/hr for the fluorspar. The same conditions as in Example 1 were maintained. Gasification was continuously operated for 5 days, and almost the same results were observed as in Example 1.

REFERENCE TEST

A 5 hour operation was carried out under the same conditions as in Example 1 except for the L/Lo ratio and the coal blowing velocity which were varied outside of the range of Example 1 to gasify coal, wherein a conventional L/Lo ratio from 0.2 to 0.3 was maintained. This ratio range is usual in the blowing operation for converter steel-making within which the decarburization efficiency of oxygen is not decreased. The distance between the iron bath surface and the lance end ranged from 850 to 1000 mm.

After 5 hours of operation under the above conditions, the operation was forced to be ceased due to the adhered mass deposited on the upper part of the furnace, hood and lance. Thus the practical advantage of the present invention has turned out evidently over the prior art.

What is claimed is:

1. A process for gasification of solid carbonaceous material in which pulverized solid carbonaceous material is top-blown onto a molten iron bath stored in a furnace through a non-submerged lance toward a hot spot formed by means of a jet of a gasifying agent comprising at least oxygen, the gasifying agent being top-blown through a non-submerged lance, the solid carbonaceous material being blown by means of a carrier gas, and slag-forming material being optionally added into the furnace by the lump or blown toward the hot spot, thereby the solid carbonaceous material being gasified, wherein the improvement comprises that the ratio $L/L_o$ of the depression depth L of the molten iron bath to the molten iron bath depth $L_o$ is maintained from 0.05 to 0.15, and the blowing velocity of the solid carbonaceous material is maintained from 50 to 300 m/sec so that formation of an adhered mass on the upper part of the furnace, hood or lance is suppressed.

2. A process as defined in claim 1, wherein the ratio $L'/L_o$ of the penetration depth L' of the solid carbonaceous material into the molten iron bath to the molten iron bath depth $L_o$ is maintained from 0.15 to 0.3.

3. A process as defined in claim 1 or 2, wherein the ratio $L/L_o$ is maintained from 0.1 to 0.15.

4. A process as defined in claim 1 or 2, wherein the ratio $L/L_o$ is adjusted by changing the distance between the molten iron bath surface and lance end, or by changing the velocity of the gasifying agent.

5. A process as defined in claim 1 or 2, wherein the gasification agent consists essentially of oxygen or a mixture of oxygen and steam.

6. A process as defined in claim 1 or 2, wherein the solid carbonaceous material is coal, coke, pitch, coal-tar or a mixture thereof.

7. A process as defined in claim 1 or 2, wherein the solid carbonaceous material is blown through a multi-nozzle lance through which the gasifying agent is blown.

8. A process as defined in claim 7, wherein the solid carbonaceous material is blown through a center nozzle of the multi-nozzle lance.

9. A process as defined in claim 5, wherein steam is blown through a nozzle of the multi-nozzle lance for blowing coal and oxygen.

10. A process as defined in claim 9, wherein steam is blown through an annular slit nozzle or multi-nozzles encircling a center nozzle.

* * * * *